US005219515A

United States Patent [19]

Chabot et al.

[11] Patent Number: 5,219,515

[45] Date of Patent: Jun. 15, 1993

[54] SUPPORT EJECTION DEVICE FOR A STREAM-PROTECTOR TUBE IN A CONTINUOUS-CASTING INSTALLATION

[75] Inventors: Francis Chabot, Arles; Gérard Zurita, Saint Martin de Crau, both of France

[73] Assignee: Sollac, Puteaux, France

[21] Appl. No.: 825,070

[22] Filed: Jan. 24, 1992

[30] Foreign Application Priority Data

Feb. 7, 1991 [FR] France ..... 91 01388

[51] Int. Cl.[5] ..... B22D 41/56

[52] U.S. Cl. ..... 266/236; 222/607

[58] Field of Search ..... 222/606, 607; 266/236, 266/287

[56] References Cited

U.S. PATENT DOCUMENTS 4,131,220 12/1978 Bode, Jr. et al. ..... 222/607
4,262,827 4/1981 DeMasi et al. ..... 222/607
4,381,102 4/1983 King ..... 222/607

FOREIGN PATENT DOCUMENTS 2378590 8/1978 France .
2441449 6/1980 France .
2171348 8/1986 United Kingdom .

*Primary Examiner*—Scott Kastler
*Attorney, Agent, or Firm*—Oblon, Spivak, McClelland, Maier & Neustadt

[57] ABSTRACT

The subject of the present invention is a support ejection device for a stream-protector tube (5), located between the pouring ladle (1) and the tundish (3) of molten metal of a continuous-casting installation.

The device comprises a support member (20) of the protector tube (5) connected to a manipulator (12) intended to bring the protector tube (5) underneath the pouring ladle (1) and the pouring ladle (1) is equipped with means for temporary joining with the said protector tube, such as a nozzle providing a seal. The support member (20) comprises a first element (21) integral with the protector tube (5) and a second element (23) integral with the manipulator (12) and automatic means for mutually locking and unlocking the elements (21, 23), permitting the ejection of the stream-protector tube (5) from the pouring ladle (1) in the event of mishaps during casting.

9 Claims, 3 Drawing Sheets

SUPPORT EJECTION DEVICE FOR A STREAM-PROTECTOR TUBE IN A CONTINUOUS-CASTING INSTALLATION

The present invention relates to a support ejection device for a stream-protector tube, located between the pouring ladle and the tundish of molten metal of a continuous-casting installation.

In continuous-casting installations, the flow of the molten metal between the pouring ladle and the tundish is effected by passing into a stream-protector tube.

This tube, fastened to the end of the tap hole of the ladle, is immersed in the tundish in order to guide the stream, to prevent the renitriding of the metal and its oxidation due to its contact with the air, and to prevent the entrainment of slag and cinders present on the surface of the molten metal contained in the tundish, either towards the bottom, due to the emulsion created by the descent of the metal from the pouring ladle towards the tundish, or towards the outside of the tundish due to possible splashing as a result of the said descent.

The stream-protector tube is integral with a support member which is itself connected to a manipulator which makes it possible to bring this protector tube underneath the pouring ladle.

The pouring ladle is equipped in its bottom with a tap hole of vertical axis comprising a slide gate and means for temporary joining with the stream-protector tube, such as a nozzle providing a seal.

At the moment of casting the molten metal, the protector tube is brought by the manipulator underneath the pouring ladle and held with the latter in the axis of the tap hole.

In the event of mishaps at the moment of casting, such as, for example, a resurgence of molten metal at the neck connecting the stream-protector tube with the nozzle, or an infiltration of molten metal at the level of the slide gate welding the protector tube onto this slide gate, it is necessary rapidly to separate the protector tube and to remove the pouring ladle and the manipulator of the said protector tube as a matter of urgency.

In point of fact, the support devices used hitherto do not permit rapid removal of the manipulator of the stream-protector tube, except manually, which poses problems of safety for the operator, particularly due to splashing of molten metal, and of speed of removal of the equipment.

The subject of the present invention is thus a support device for the stream-protector tube of a continuous-casting installation which remedies these drawbacks and permitting, in the event of mishaps, an automatic ejection of the protector tube in order to free the pouring ladle and the manipulator for their urgent removal.

The present invention relates to a support ejection device of a stream-protector tube, located between the pouring ladle and the tundish of molten metal of a continuous-casting installation, the said device comprising a support member of the protector tube connected to a manipulator intended to bring the protector tube underneath the pouring ladle, the said pouring ladle being equipped with means for temporary joining with the said protector tube, characterised in that the support member comprises a first element integral with the said protector tube and a second element integral with the said manipulator and automatic means for mutually locking and unlocking the said elements, permitting the ejection of the said stream-protector tube from the pouring ladle in the event of mishaps during casting.

According to other characteristics of the invention:

the automatic locking and unlocking means comprise at least two locks articulated at the end of the second element intended to receive the first element, the said locks are driven in rotation on a control member between a first blocking position of the first element with the said second element and a second release position of the said first element, the control member is formed by a moveable rod supported by the said second element integral with the manipulator, the moveable rod has one of its ends connected to an actuator for displacing the said moveable rod, the moveable rod comprises a first part for holding the said locks in the first blocking position of the said first element with the said second element and a second part for tilting the said locks into the second release position of the first element, the said second part extending the said first part on the side of the free end of the moveable rod, the said second part is formed by a truncated cone whose slope faces the free end of the moveable rod, the moveable rod comprises, at its free end, a plate for holding the said locks in the second release position of the said first element, the end of the second element intended to receive the first element of the support member is provided with at least two deflectors in order to prevent the engagement of the said first element with the said locks at the moment of the ejection of the stream-protector tube.

BRIEF DESCRIPTION OF THE DRAWINGS

The invention will be described in greater detail below with reference to the appended drawings which are given solely by way of example and in which:

As shown in FIG. 1, a continuous-casting installation is composed of a pouring ladle 1 supported, for example, by a gantry (not shown) and containing the molten metal 2.

Figure 1:
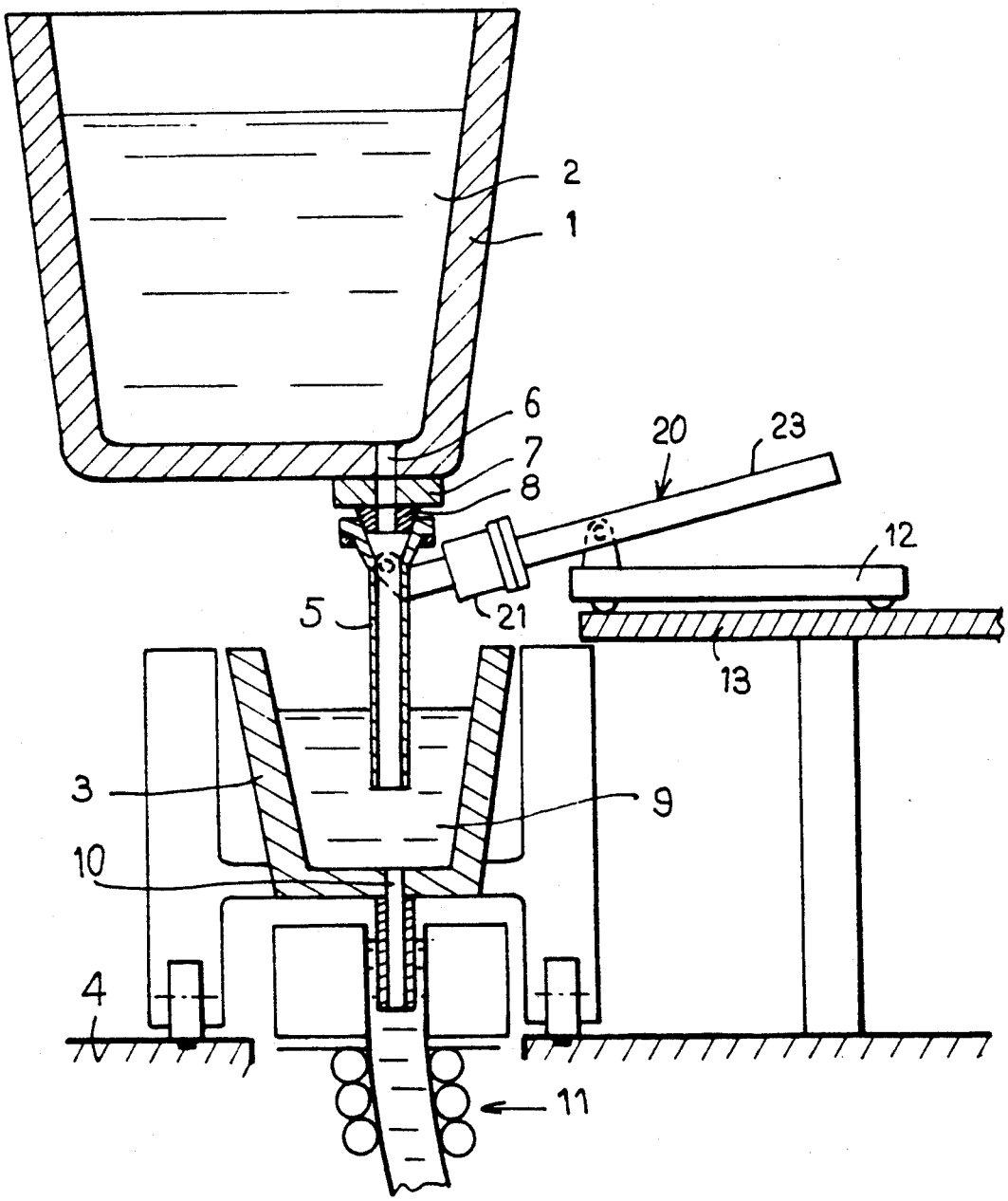
FIG. 1 is a diagrammatic view of a continuous-casting installation.

The pouring ladle 1 is arranged above a tundish or distributor 3 supported by a casting floor 4 by suitable means. Between the pouring ladle 1 and the tundish 3, the metal is guided by a stream-protector tube 5.

The pouring ladle 1 is of known type and is equipped in its bottom with a tap hole 6 of circular vertical axis and comprising, on the one hand, a slide gate 7 and, on the other hand, means 8 for temporary joining with the protector tube 5, such as a nozzle providing a seal.

The tundish 3, located under the pouring ladle 1, is filled with a bath of molten metal 9 and is equipped in its bottom with a hole 10 connected in a known manner to a continuous-casting line 11.

The stream-protector tube 5 is a vertical tube with an axis coincident with the axis of the tap hole 6 of the ladle 1 and its lower end is immersed in the bath 9 of molten metal of the tundish 3 in order to prevent, in particular, the renitriding of the metal and its oxidation due to its contact with the air.

The stream-protector tube 5 is connected to a support member, denoted overall by the reference 20, which is itself supported by a manipulator 12 intended to bring the said protector tube underneath the tap hole 6 of the ladle 1.

The manipulator 12 is displaced in a direction perpendicular to the tap hole 6 on a floor 13 located at the level of the upper part of the tundish 3.

Figure 2:
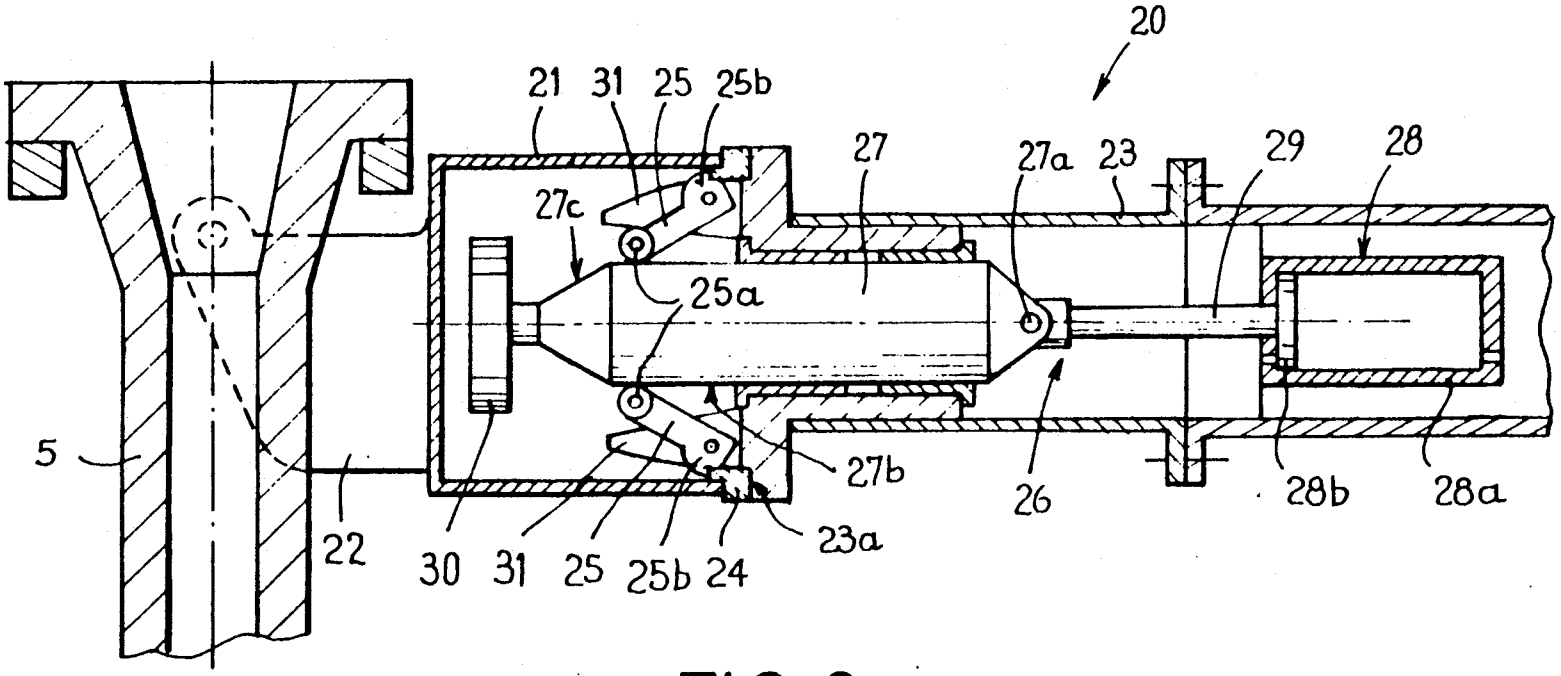
FIG. 2 is a view in longitudinal section of the support member of the stream-protector tube in the connected position.
Figure 3:
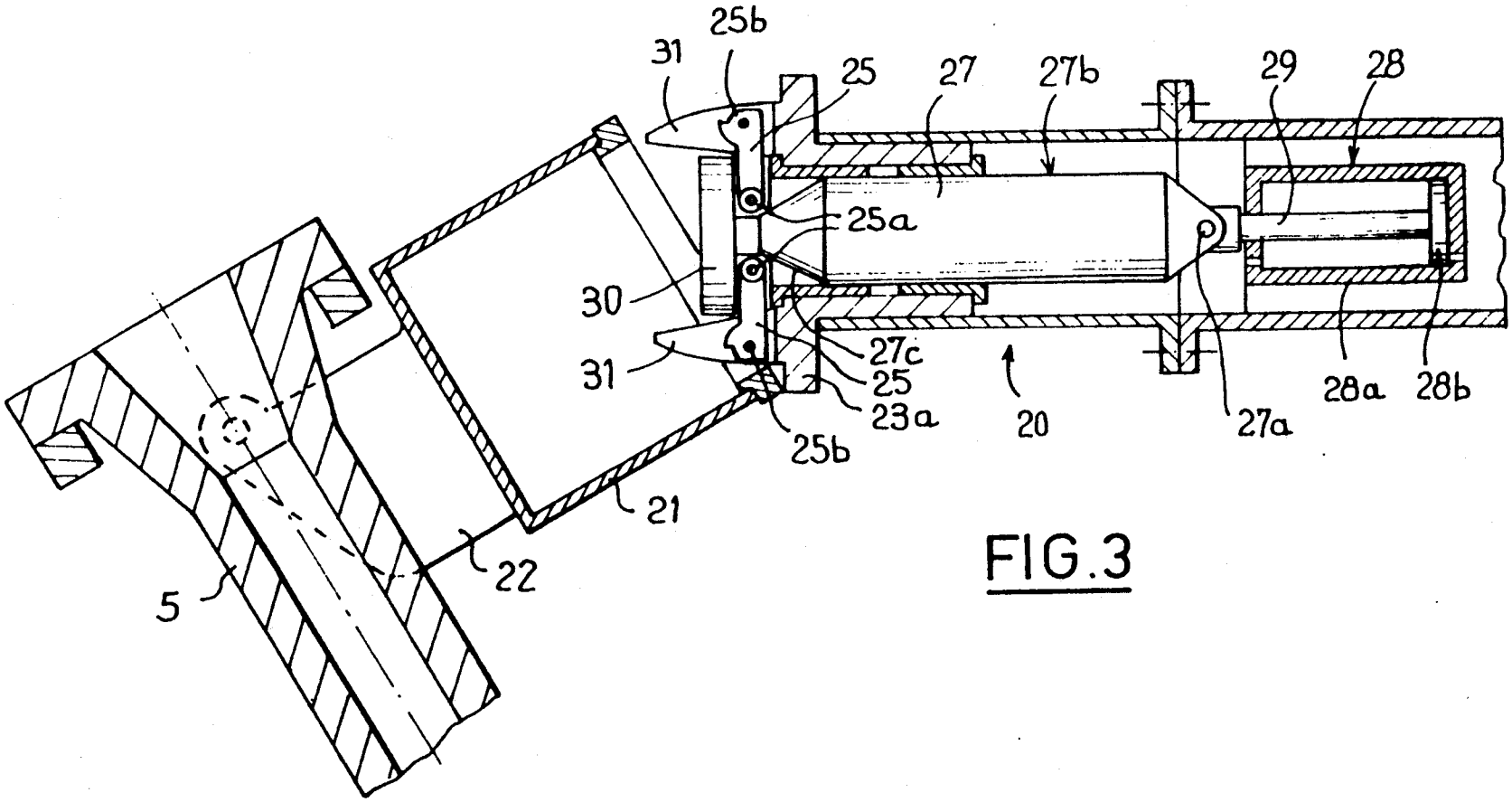
FIG. 3 is a view in longitudinal section of the support member of the stream-protector tube in the disconnected position.

With reference, now, to FIGS. 2 and 3, a more detailed description will be given of the support member 20 of the stream-protector tube 5.

This support member 20 is composed of a first tubular element 21, integral with the protector tube 5 via fastening brackets 22 and of a second tubular element 23 integral with the manipulator 12.

The face of the first element 21 opposite the protector tube 5 is equipped with a ring 24 intended to be applied in a groove 25 provided on the end 23*a* of the second element 23.

Moreover, the support member 20 is provided with automatic means for mutually locking and unlocking the elements 21 and 23, permitting the separation of the said elements and the ejection of the stream-protector tube 5 of the pouring ladle 1 in the event of mishaps during casting.

These locking and unlocking means comprise at least two locks 25 mounted in an articulated manner on the end 23*a* of the second element 23.

The number of locks 25 is preferably 3 or 4, uniformly distributed on the end 23*a*.

The locks 25 are driven in rotation by a control member 26 between a first blocking position of the first element 21 with the second element 23 (FIG. 2) and a second release position of the first element 21 (FIG. 3).

The control member 26 is formed by a moveable rod 27 supported by the second element 23 and by an actuator 28 for displacing the said rod.

This actuator 28 comprises, in a conventional manner, a body 28*a* in which a piston 27*b* is displaced, providing two chambers in the said body, the said piston being integral with an actuator rod 29 whose free end is connected to the end 27*a* of the moveable rod 27.

This moveable rod 27 comprises a first part 27*c* for holding the locks 25 in the first blocking position of the first element 21 on the second element 23 and a second part 27*c* for tilting the said locks into the second release position of the first element 21.

The second part 27*c* extends the first part 27*b* on the side of the free end of the moveable rod 27 and is formed, for example, by a truncated cone whose slope faces the said free end.

The moveable rod 27 also comprises, at its free end, a plate 30 for holding the locks 25 in the second release position of the first element 21 relative to the second element 23.

Moreover, the end 23*a* of the second element 23 intended to receive the first element 21 is provided with at least two deflectors 31 in order to prevent the engagement of this first element 21 with the locks 25 at the moment of the separation of the elements 21 and 23 and of the ejection of the stream-protector tube 5.

The device operates as follows.

During the casting of the molten metal, the protector tube 5 is attached under the ladle 1 at the level of the tap hole 6, and the two elements 21 and 23 of the support member 20 are mutually joined by the locks 25.

To this end, the rod 27, through the action of the actuator 28, is in an extended position, as shown in FIG. 2.

Thus, each end 25*a* of the locks 25 interacts with the first part 27*b* of the moveable rod 27 so that each opposing end 25*b* of the said locks blocks the first element 21 on the second element 23.

In the event of mishaps during casting, a pressurised fluid is conveyed in the actuator 28 on the side of the actuator rod 29, which has the effect of driving the moveable rod 27.

Therefore, each end 25*a* of the locks 25 slides over the conical second part 27*c* of the moveable rod 27 and the plate 30 drives, by rotation, the locks 25 into a retracted position, thus releasing the first element 21 and bringing about the automatic ejection of the protector tube 5, which permits the rapid removal of the pouring ladle.

The objective sought is thus achieved in an effective manner and using particularly simple and inexpensive means.

We claim:

1. A support ejection device for a stream-protector tube (5), which tube is located between a pouring ladle (1) and a tundish (3) of molten metal of a continuous-casting installation, said device comprising a support member (20) of the protector tube (5) connected to a manipulator (12) intended to bring the protector tube (5) underneath the pouring ladle (1), said pouring ladle (1) being equipped with means for temporary joining with the said protector tube (5), wherein said support member (20) comprises a first element (21) integral with said protector tube (5) and a second element (23) integral with said manipulator (12) and automatic means (25, 26, 27) for mutually locking and unlocking said first and second elements (21, 23), permitting the ejection of the stream-protector tube (5) from the pouring ladle (1) in the event of mishaps during casting.

2. A support ejection device according to claim 1, characterised in that the automatic means for mutually locking and unlocking said first and second elements (21, 23) comprise at least two locks (25) mounted in an articulated manner at the end (23*a*) of the second element (23) intended to receive the first element (21).

3. A support ejection device according to claim 2, characterised in that said at least two locks (25) are driven in rotation by a control member (26) between a first blocking position of the first element (21) with the said second element (23) and a second release position of said first element (21).

4. A support ejection device according to claim 3, characterised in that the control member (26) is formed by a moveable rod (27) supported by the said second element (23) integral with the manipulator (12).

5. A support ejection device according to claim 4, characterised in that the moveable rod (27) has one of its ends connected to an actuator (28) for displacing the said moveable rod (27).

6. A support ejection device according to claim 4, characterised in that the moveable rod (27) comprises a first part (27*b*) for holding the said locks (25) in the first blocking position of the said first element (21) with said second element (23) and a second part (27*c*) for tilting said locks (25) into the second release position of the first element (21), said second part (27*c*) extending said first part (27*b*) on the side of the free end of the moveable rod (27).

7. A support ejection device according to claim 6, characterised in that the said second part (27*c*) is formed by a truncated cone whose slope faces the free end of the moveable rod (27).

8. A support ejection device according to claim 4, characterised in that the moveable rod (27) comprises, at its free end, a plate (30) for holding the said locks (25) in the second release position of the said first element (21).

9. A support ejection device according to claim 1, characterised in that the end (23*a*) of the second element (23) intended to receive the first element (21) of the support member (20) is provided with at least two deflectors (31) in order to prevent the engagement of the said first element (21) with the said locks (25) at the moment of the ejection of the stream-protector tube (5).

* * * * *